United States Patent [19]

Bradford et al.

[11] Patent Number: 5,060,836

[45] Date of Patent: Oct. 29, 1991

[54] CARRYING DEVICE

[76] Inventors: Tracy W. Bradford; Ryan W. Bradford, both of 14690 Pepperidge, Grand Haven, Mich. 49417

[21] Appl. No.: 526,039

[22] Filed: May 18, 1990

[51] Int. Cl.[5] ..... A45F 5/00

[52] U.S. Cl. ..... 224/271; 224/272; 224/910

[58] Field of Search ..... 224/261, 262, 265, 266, 224/270, 271, 272, 910, 161, 211; 84/421; 108/43

[56] References Cited

U.S. PATENT DOCUMENTS

| | | | |
|---|---|---|---|
| 2,552,205 | 5/1951 | Moss | 224/272 X |
| 2,822,117 | 2/1958 | Mack | 224/161 |
| 2,861,854 | 11/1958 | Best | 224/270 X |
| 3,021,744 | 2/1962 | Kester | 224/265 X |
| 3,106,123 | 10/1963 | Johannsen | 224/910 X |
| 3,322,312 | 5/1967 | Mitchell | 224/211 |
| 3,767,095 | 10/1973 | Jones | 224/270 X |
| 3,774,823 | 11/1973 | Hoellerich | 224/910 X |
| 3,878,589 | 4/1975 | Schaefer | 224/272 X |
| 4,256,007 | 3/1981 | Streit | 224/910 X |
| 4,387,839 | 6/1983 | Dranchak | 224/265 |
| 4,402,441 | 9/1983 | Jones et al. | 224/910 X |
| 4,453,442 | 6/1984 | LaFlame | 224/910 X |
| 4,605,144 | 8/1986 | La Flame | 224/265 |
| 4,634,032 | 1/1987 | LaFlame | 224/910 X |
| 4,715,293 | 12/1987 | Cobbs | 224/265 X |
| 4,799,610 | 1/1989 | Hsieh | 224/910 X |

FOREIGN PATENT DOCUMENTS

| | | | |
|---|---|---|---|
| 593792 | 3/1960 | Canada | 224/262 |

*Primary Examiner*—Henry J. Recla
*Assistant Examiner*—Robert M. Fetsuga
*Attorney, Agent, or Firm*—Varrum, Riddering, Schmidt & Howlett

[57] ABSTRACT

A frame structure for carrying a drum or other object in front of a person has a front support member engaging two substantially parallel side support members extending generally horizontally along the waist of a person, and is supported by the hips of a person. A back member, attached to the side support members, engages the back thoracic region of a wearer and provides a counteracting force to keep a drum or other carried article in a desired position. The back member includes a pair of telescoping lengthwise adjustable back support members terminating in a hinge point at a back plate. The back plate is provided with arcuate slots through which attaching bolts engage a flanged member of each of the back support members. This arrangement allows the angle between the two back support members to be adjusted in order to adjust the distance between the side members along the back of the person. The width of the frame may also be adjusted along the front of the person by adjustment of overlapping angle plates of the front support member. The side support members are slidably engaged with the front and back members to allow for adjustment in the front to back direction of the frame, thereby effectively changing the distance between the hip supported fulcrum and the front and back members. The frame is supported on the hips by means of a belt and pad assembly which removably attaches to the frame.

25 Claims, 9 Drawing Sheets

CARRYING DEVICE

BACKGROUND OF THE INVENTION

The invention relates to apparatus for carrying objects such as musical instruments and the like and more particularly to such apparatus embodying a construction which distributes forces resulting from the weight of a carried device away from bothersome areas of the human body.

The prior art includes a number of carrying devices for supporting articles on the body of a person, such as percussion drums, trays for carrying food items, cameras, computers and the like. Prior art systems generally include shoulder straps or frames which extend over the shoulder of the person carrying the device, thereby exerting a compressing force on the spine which can result in severe back pain. Such devices also tend to exert a pivotal moment in the forward direction on the upper portion of the torso, further contributing to back discomfort.

One prior art arrangement disclosed in U.S. Pat. No. 4,256,007 to J. L. Streit (dated Mar. 17, 1981) comprises a rigid supporting frame having spaced-apart hooks for engaging the shoulder blades of the person and a back portion adapted to contact the back of the person. Such arrangement, however, does not substantially reduce the downward force on the spine or a forward pivotal moment on the upper torso.

In another prior art arrangement disclosed in U.S. Pat. No. 4,634,032 to T. R. LaFlame (dated Jan. 6, 1987), a carrying device includes a bracket extending outwardly for supporting an instrument at an outwardly overhung position in front of the waistline area of a person. A rigid band extends along a portion of the waistline to the back of the person and a riser arm extends upward from the band along the back thoracic region of the person. The weight of the carrying device and any instrument attached thereto is supported on the shoulders of the person by straps or shoulder hooks. One problem with these prior art arrangements is that the weight of the items is supported by the shoulders, exerting a compressing force on the spinal column. Another problem with this prior art arrangement is that the fulcrum of the pivotal moment, and hence the primary downward force, is positioned in front of the person, causing a forward bending pressure on the upper torso.

SUMMARY OF THE INVENTION

These and other problems of the prior art are overcome in accordance with this invention in a load-carrying device for carrying a musical instrument or the like which transfers the weight of the load to the hips of a person, thereby avoiding the downward pressure on the spine and the forward bending moment in the area of the neck and shoulders resulting from the use of prior art devices supported by the upper torso. A frame structure for carrying a musical instrument or the like, in accordance with this invention, comprises a generally horizontally extending cross member for supporting a load such as a musical instrument or the like, attached to a pair of side support members extending generally horizontally along the sides of a person in the region of the waist, and a reaction member attached to the side members and extending generally upwardly from the waist region. The side support members include means for attachment to a belt or similar supporting device in a region near the top part of the hips of the wearer. Advantageously, this arrangement transfers the weight of any load to the top region of hips, allowing the weight to be supported by the legs and hips of the wearer without placing any downward forces on the spine. In accordance with one aspect of the invention, the side support members are pivotally engaged with a support device supported on the top region of the hips, whereby the frame structure is pivotally supported about a fulcrum positioned on a line extending between the top regions of the hips. The reaction member functions to counteract pivotal forces about the fulcrum to keep the instrument or other carried device at a desired position. Advantageously, the carrier frame in accordance with this invention may be used to support a load, such as a drum, in front of a person by positioning the load-supporting cross member in front and allowing the reaction member to contact the back of the person. Alternatively, a load, such as a backpack, may be supported behind the person by positioning the load-supporting cross member behind the person and allowing the reaction member to contact the person's chest. In accordance with another aspect of the invention, the carrier frame is provided with a pair of support members extending upwardly from the side members and interconnected by a top support bar. Advantageously, the carrier may be readily used to support an overhead load, such as a canoe or the like.

In one embodiment of the invention, the load-supporting cross member comprises a pair of overlapping support members and means for adjustably positioning the support members relative to each other to provide a frontal width adjustment of the frame. A load support device may be adjustably attached to the overlapping support members at a convenient position for the wearer. In one specific embodiment of the invention, the cross member is provided with an angle adaptor assembly for adjustably positioning the angle of the surface of a drum or platform or the like. The angle adaptor assembly comprises a structure consisting of a top plate and two side plates extending generally at right angles to the top plate. The side plates each comprise a back edge extending generally at right angles to the top edge of the side and a front edge extending at an acute angle to the top edge. The assembly further includes a horizontally extending member engaging the front edge of the two side plates and an adjustment shaft extending downward through an opening in the top plate and engaging the horizontal member through a threaded opening in the horizontal member. A pivotal member, to which a carried device is attached, is pivotally supported by the two side plates near the top edge of the side plates and rests against the horizontal member. Advantageously, the angular position of the pivotal member, and hence of a drum or like carried device, may be adjustably altered by a turning of the adjustment member which causes the horizontal member to move along the angularly extending front edge of the side members and causes the pivotal member to change its angular position as the horizontal member traverses the front edges of the side members.

In one embodiment of the invention, the load-supporting cross member comprises a horizontally extending top plate and a vertically extending front plate removably engaged with each of the side support members by means of a fork arrangement. The fork arrangement on each side support member comprises at least one vertically extending member for engagement with an opening in the top plate of the cross member and at least one horizontally extending member for engagement with an opening in the front plate of the cross member. Advantageously, this arrangement provides a safety feature in that it allows for quick and easy disengagement, particularly in a fall, reducing risk of injury to the person.

In one specific embodiment of the invention, to provide greater comfort for the wearer, the reaction member is formed to extend in a plane forming an angle of less than 90 degrees with a plane extending horizontally through the side members. The reaction member may comprise a pair of reaction support members, each engaging one of the pair of side support members and pivotally attached at a position near the top part of the reaction member. The reaction member may be further provided with a back support plate having slots therein for attachment to the reaction support members at a plurality of angular adjustment positions. Advantageously, the arrangement of this invention allows for convenient width adjustment of the frame structure along the back of the wearer as well as along the front. The reaction member may further comprise a pad loosely attached to the support plate to allow for motion between the plate and the pad, thereby preventing unnecessary rubbing of the pad against the body of a person wearing the frame structure. Each of the reaction support members engage the side support members in a telescoping manner to allow for vertical adjustment of the support plate for comfortable positioning of the back pad for wearers of different physical structure.

In one specific embodiment of the invention, the two side support members each comprise overlapping members and means for securing the overlapping members in position relative to each other to allow for a front to back dimension adjustment. The side members may be pivotally attached to a belt or the like by means of a releasable pivot attachment device such as a rounded dovetail or the like by which the male dovetail portion is engaged with a correspondingly machined vertically extending slot. Advantageously, such an arrangement provides for ease of engagement and disengagement in normal operations and enhances disengagement in case of a fall, thereby reducing the chances of injury to the wearer.

In one embodiment of the invention, the belt assembly is provided with a support plate attached to the belt and a hip support pad loosely connected to the support plate. Advantageously, the support plate provides a means for easy attachment to a standard belt and provides a larger area for support on the hips. Furthermore, the pad provides additional comfort and is loosely connected to the plate to reduce movement between the wearer and the pad, thereby reducing rubbing or chafing actions.

In one specific embodiment of the invention, the loadsupporting cross member is rotationally engaged to the side support members by a frictional interconnecting surface. Advantageously, the load-supporting cross member may be selectively positioned and maintained in any rotational orientation to selectively support loads at different angles. The load-supporting cross member comprises overlapping adjustment members slidably engaged by means of a groove in one surface of one of the adjustment members and a tonguelike extension on the mating surface of the other. A load attachment member is provided with a tonguelike extension for slidable engagement with a corresponding groove in the cross member. A threaded stud on the attachment member engages a horizontally extending slot in the cross member for selective horizontal positioning of the attachment member on the cross member.

BRIEF DESCRIPTION OF THE DRAWING

The invention is described with reference to the drawing, in which.

DETAILED DESCRIPTION

Figure 1:
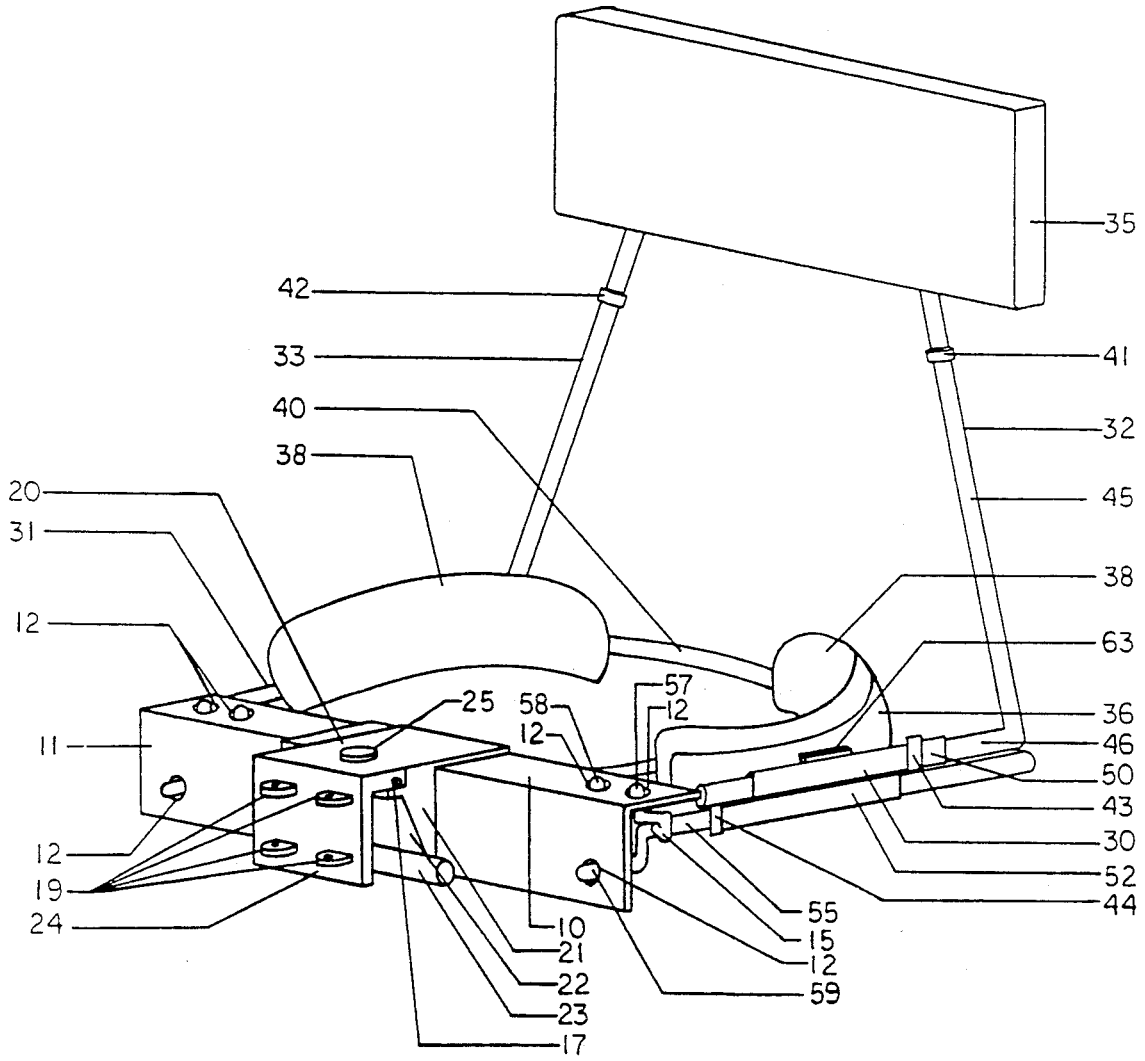
FIG. 1 is a perspective view of a carrying frame in accordance with this invention.
Figure 5:
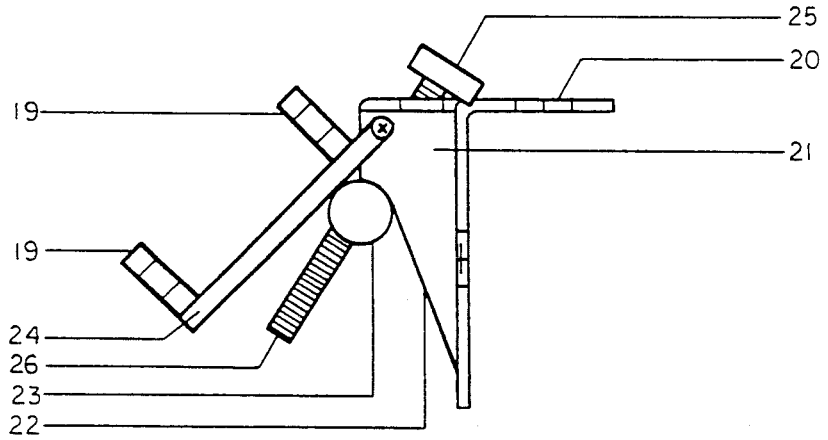
FIG. 5 is a left side elevation of the angle adaptor assembly of FIG. 1.

FIG. 1 is a perspective view of an illustrative support frame in accordance with the invention. A front support member consists of a pair of overlapping angle plates 10 and 11 attached to each other for sliding engagement in a standard fashion to provide for a width adjustment of the support frame along its front area. Each of the overlapping plates 10, 11 is provided with a plurality of holes for engaging prongs of a front fork assembly 15. The front support member includes an angle adaptor adaptor assembly 17 for supporting a musical drum or the like. The angle adaptor assembly 17 comprises a top plate 20 and a pair of side plates 21, each having an angularly extending front edge 22. Only the left side plate 21 is visible in FIG. 1. The right angularly extending side plate is similarly configured. A support rod 23 rests against the angular edges 22 and supports an instrument support plate 24. A drum or the like will attach to the support plate 24 by means of support lugs 19 in a standard manner. A threaded shaft provided with a knob 25 extends through the top plate 20 and is in threaded engagement with rod 23. FIG. 5 is a left side elevation of the angle adaptor assembly. As will be apparent from FIG. 5, a turning of knob 25 of the threaded adjustment shaft 26 causes the support rod 23, which is in threaded engagement with shaft 26, to travel along the angular front edge 22. The angular position of the support plate 24, and hence the angular position of a carried device, will be altered as the rod 23 is raised or lowered.

Figure 2A:
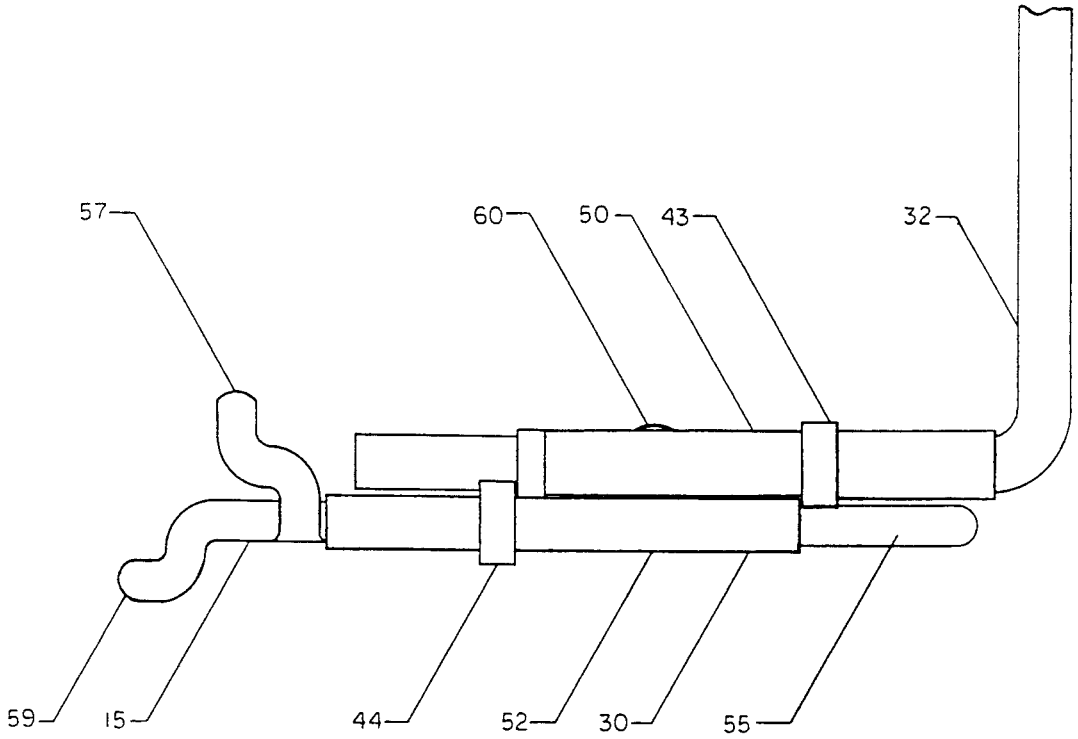
FIG. 2A is a left side elevation of the left side support member of the frame structure of FIG. 1.
Figure 2B:
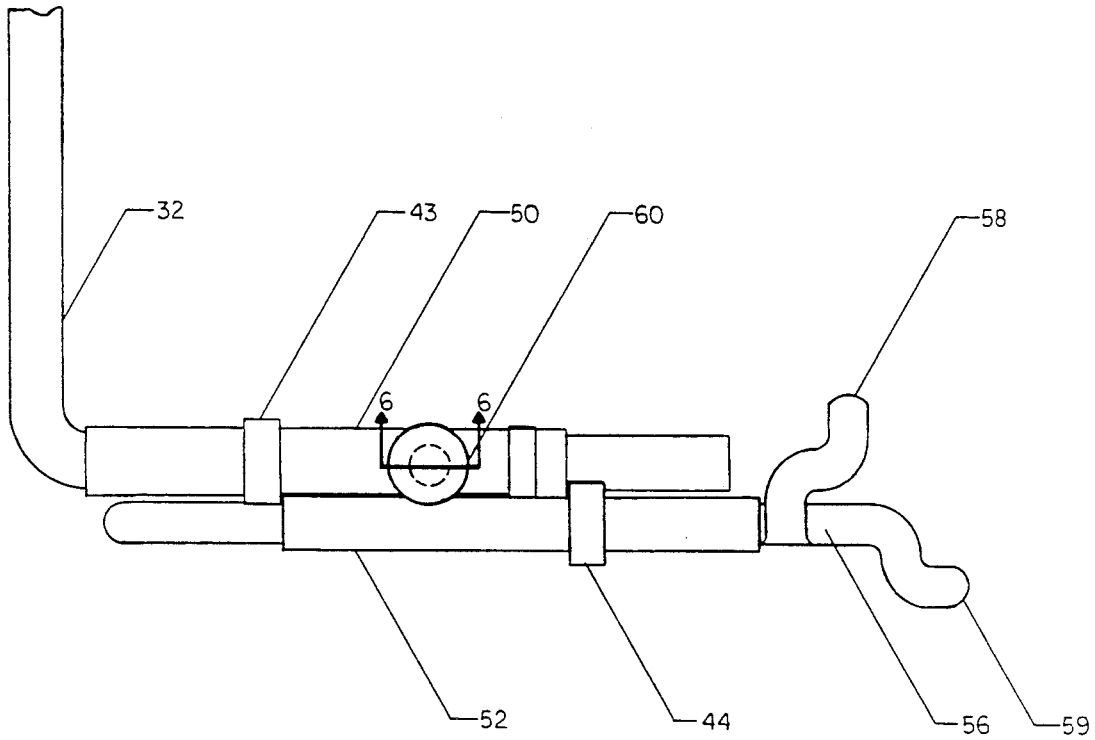
FIG. 2B is a right side elevation of the left side support member of the frame structure of FIG. 1.
Figure 6:
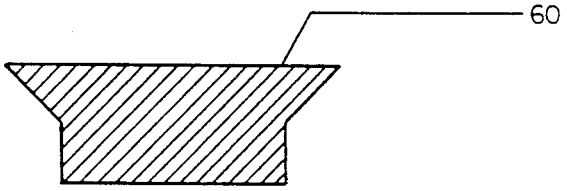
FIG. 6 is a cross-sectional view of a dovetail member by which the side support members attach to the support assembly taken along line 6—6 of FIG. 2B.

Further shown in FIG. 1 are left and right side support members 30 and 31, respectively, and a back member comprising back support members 32 and 33 and a back pad assembly 35. The side support members 30 and 31 are removably attached to hip plates 36 which in turn are attached to hip pads 38. A belt 40 engages the hip plates 36 and pads 38 to keep the frame structure in position on the wearer. The left side support member 30 and right side support member 31 are identical except for orientation. Only the left side support member 30 will be described in detail. The left side support member 30 comprises a tubular housing 50 for slidably engaging a tubular back support member 32. A collar 43 surrounds tubular housing 50 and is provided with a set screw (not shown in the drawing) extending through housing 50 and engaging the portion of the back support member 32 extending into the housing 50 to secure the back support member 32 in the housing 50. A further tubular housing 52 is rigidly attached to housing 50 by welding or the like. FIG. 2A is a left side elevation of the left side support member 30. As shown in the drawing, housing 52 is positioned below housing 50 and slidably engages a tubular front fork support member 55. The tubular housing 52 is provided with a collar 44 and a set screw (not shown in the drawing) extending through collar 44 and tubular housing 52 for engagement with tubular fork support member 55 to maintain the member 55 in position relative to the housing 52. Housings 50 and 52, with collars 43 and 44, respectively, provide front-to-back adjustment of the back support member 32 and of the front fork support member 55, to accommodate wearers of different physical proportions. The right side support member 30, being constructed in the same fashion of the left side support member 31, similarly allows for front-to-back adjustment of back member 33 and of front fork support member 65, shown in FIG. 1. FIG. 2B is a right side elevation of the left side support member 30. Visible in FIG. 2B is a male dovetail pivot assembly member 60 for sliding engagement with a corresponding female dovetail member 63 on the hip plate assembly 36. FIG. 6 shows a cross section of the male dovetail member 60.

Figure 2C:
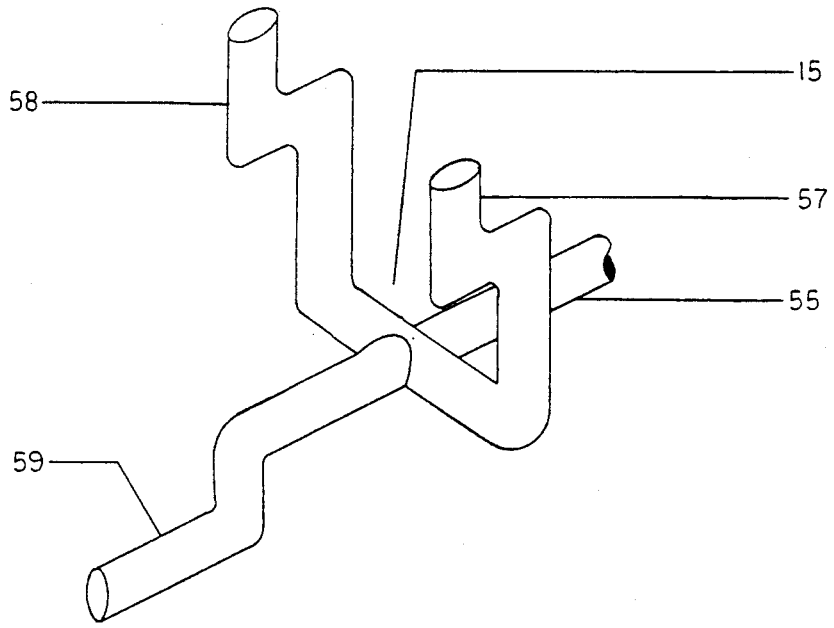
FIG. 2C is a perspective view of a device for engagement to the front member of the frame structure of FIG. 1.

The front fork support member 55 is provided with a front fork assembly 15 shown in perspective in FIG. 2C. The fork assembly comprises two members 57 and 58 extending in the vertical direction and a member 59 extending in the horizontal direction. The fork assembly is specifically designed to support an angle plate such as frontal plate 10 whereby a drum or other heavy object is readily engaged and supported. It is a safety feature of the particular engagement mechanism that it may be readily disengaged, for example in a fall of the person carrying the heavy object, in order to reduce the risk of injury.

Figure 3:
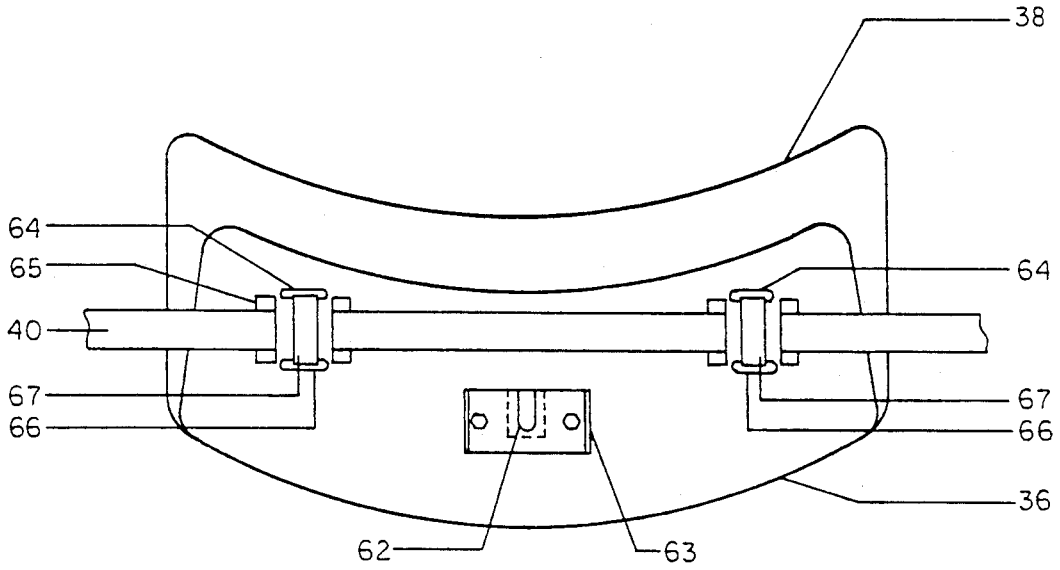
FIG. 3 is a more detailed view of a support assembly of the structure of FIG. 1.

A person carrying the support assembly will normally first put on the belt 40 equipped with the hip pads 38 and hip plate 36 provided with a female dovetail member 63 and then attach the left and right side supports to the hip plates by engaging male dovetail members on the side supports with female dovetail members on the hip plates. FIG. 3 provides a right side view of the hip plate, pad and belt assembly to be worn on the left hip of the person. The left and right hip plate and pad assemblies are essentially identical except for orientation. Hip plate 36 has attached thereto female dovetail members 63 having a detent 62 to receive male dovetail member 60. While other attachment devices are readily available, the dovetail engagement was selected for ease of attachment and detachment of the frame so that a wearer can readily remove the frame without having to remove the belt. Furthermore, as a safety feature, the design of the male dovetail member 60 and the detent 62 allows for ready disengagement in case the carrier stumbles and falls, further helping to prevent injury. Upper and lower slots 64 and 66, shown in FIG. 3 provide a means for attaching the hip pad 38 to the hip plate 36 by means of straps 67 extending through the slots. Vertical slots 65 provide for engagement of the belt 40 with hip plate 36. The pad attaching straps 67 may be loosely fastened, since engagement between plate 36 and hip pad 38 is preferably loose rather than tight, to allow for movement between them when the person is walking, thereby reducing rubbing or chafing on the person.

Figure 4:
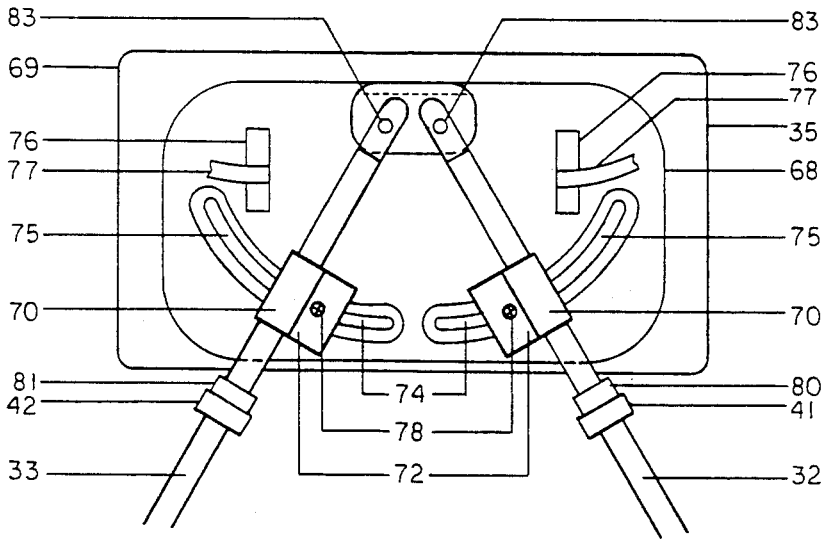
FIG. 4 is a rear elevation of the back portion of the structure of FIG. 1.

FIG. 4 is a rear elevation of the back reaction force member comprising back support members 32 and 33 and back pad assembly 35. The back support members 32 and 33 are tubular members bent at an acute angle to extend between substantially horizontal side support members 30, 31 and a nearly vertically extending back pad assembly 35. The angle between the horizontally and nearly vertically extending sections of back support members 32 and 33 is preferably an acute angle (e.g., 80°-90°) for the comfort of the wearer. Back support members 32 and 33 slidably engage tubular support members 80 and 81, respectively, in a telescoping fashion. The tubular support members 80 and 81 are hingedly attached by means of bolts 83 extending from the front and through a back plate 68 to engage the tubular members in a pivoting fashion. Tubular support members 80 and 81 are further provided with flanged attachment members 70, each having a flange 72. Bolts may be inserted from the front of the back plate 68 in arcuate slots 74 to allow the back support members 32 and 33 to be adjusted to any of a number of desired angular positions. This angular adjustment allows for width adjustment of the frame structure along the posterior waist area of a person to accommodate persons of various physical sizes. As is readily apparent from FIG. 1, a change in the angular positions of back support members 32 and 33 changes the width across the back portion of the frame. Each of the arcuate slots 74 is provided with a shoulder area 75 for supporting a plastic washer or the like for ease of angular adjustment of the support members.

Support members 32 and 33 are provided with locking collars 41 and 42, respectively. The locking collars 41 and 42 are each provided with a set screw or the like (not shown in the drawing) extending through the support members 32 and 33 to their respective engaging support members 80 and 81. By loosening of the set screws, the back pad assembly 35 may be raised and lowered with respect to back supporting members 32 and 33, allowing for comfortable positioning of the back pad assembly 35 on the wearer. The back pad assembly 35 includes a pad 69 loosely attached to the back plate 68 via straps 77 extending through slots 76. Slots 76 have been elongated in order to allow for some up and down movement of the pad relative to the back plate, thereby avoiding unnecessary rubbing or chafing against the back of the wearer.

Figure 7:
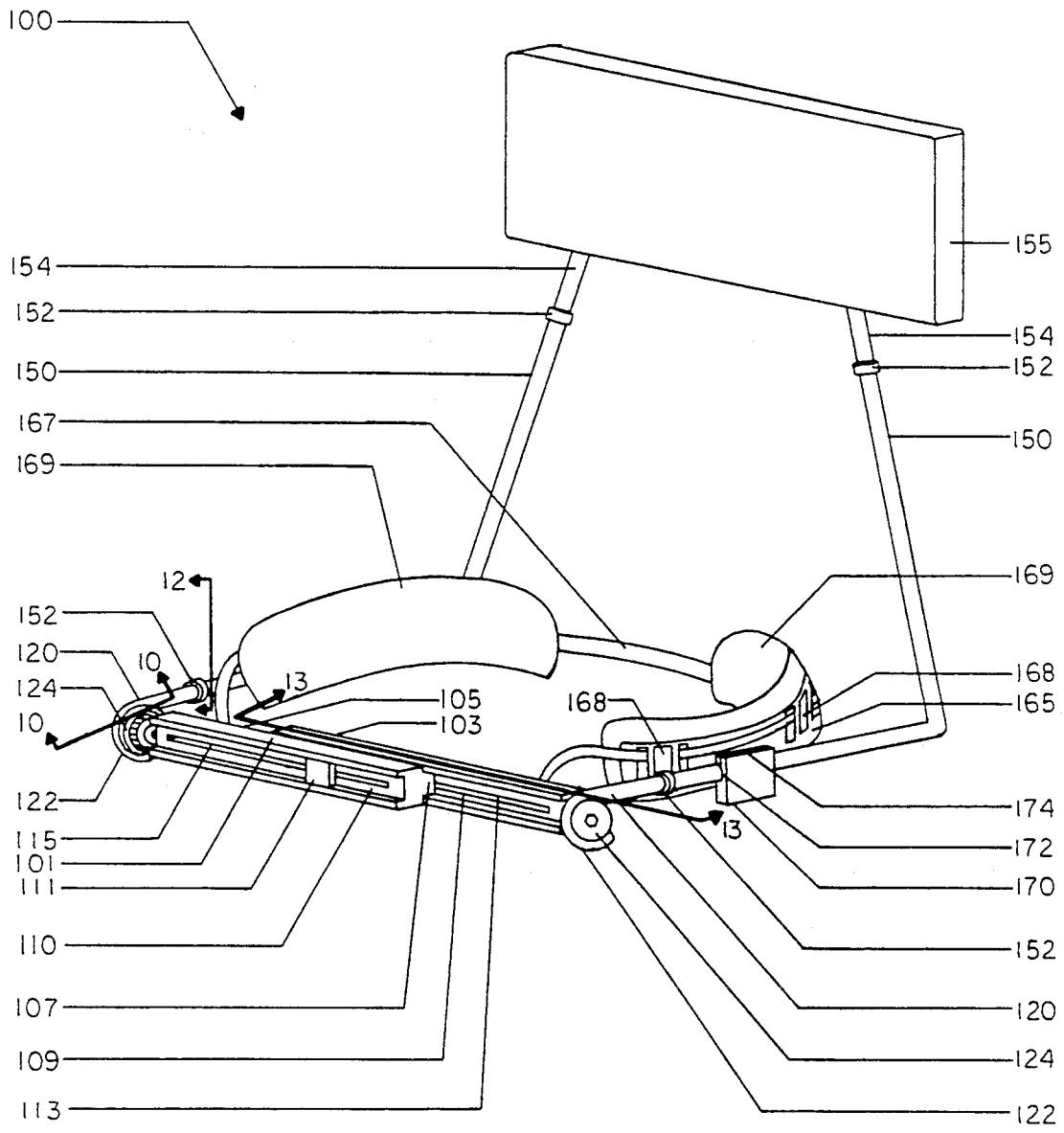
FIG. 7 is a perspective view of an alternate embodiment of a carrying frame in accordance with this invention.
Figure 10:
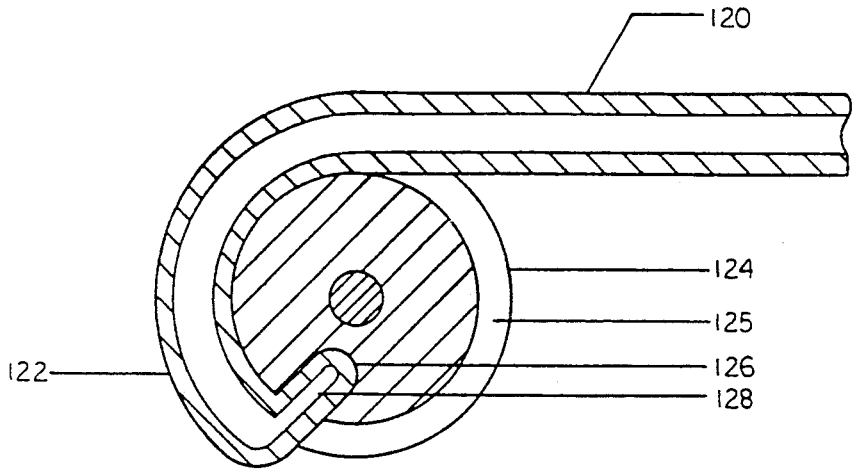
FIG. 10 is a partial cross-sectional view of a cross member attachment device along line 10—10 of FIG. 7.
Figure 13:
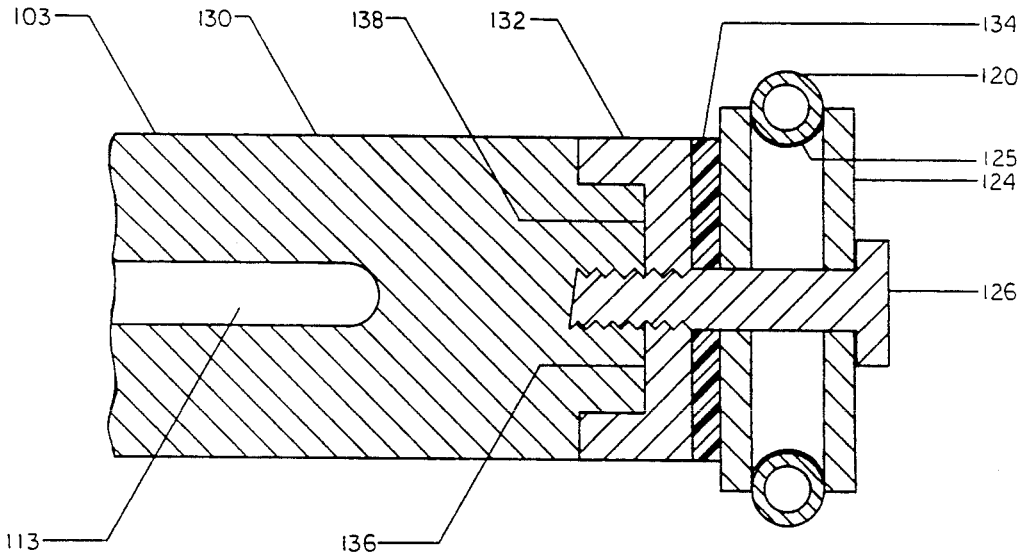
FIG. 13 is a partial cross-sectional view of a load-supporting cross member taken along line 13—13 of FIG. 7.

FIG. 7 depicts an alternate embodiment of the invention in which a hip-supported carrying device 100 is provided with a load-supporting cross member in rotatable front support assembly 101. Assembly 101 comprises a pair of adjustment members 103, 105 which are slidably engaged by means of tongue 107 and groove 109. An attachment bolt 111 extends through both adjustment members 103 and 105 in coextensive slots 113, 115. This arrangement allows for lateral adjustment of the front support assembly 101 by positioning the adjustment members 103, 105 in a desired position and appropriate tightening of a nut (not shown in the drawing) on bolt 111. The adjustment members 103, 105 may also be overlapping telescoping members to provide for lateral adjustment of the front support assembly 101. The front support assembly 101 is provided with cylindrically-shaped attachment ends 124, each having a groove for engagement with curved end sections 122 of front support arms 120. FIG. 10 is a partial cross-sectional view of the right side curved end section 122 mated to cylindrically-shaped attachment end 124, taken along line 10—10 of FIG. 7. Attachment end 124 is provided with a generally radially extending detent 126 for engaging a generally radially extending end point 128 of arm 120 and for retaining attachment end 124 in fixed engagement with front support arm 120. FIG. 13 is a partial cross-sectional view of front adjustment member 103 taken along line 13—13 of FIG. 7, showing a frictional rotational engagement of attachment end 124 to rod 130. Rod 130 is provided with an end piece 138 which engages a spacer 132 provided with a detent 136 for engaging end piece 138. Spacer 132 mechanically engages end piece 138 to prevent independent rotation of spacer 132 relative to end piece 138. A threaded bolt 126 extends through attachment end 124 and spacer 132 into the end piece 138 of rod 130. A frictional washer, made for example of silicone rubber or the like, is inserted between spacer 132 and end attachment member 124. The frictional washer provides resistance to relative rotational motion between attachment member 124 and washer 132, and hence rod 130, when bolt 126 is firmly tightened.

Figure 9:
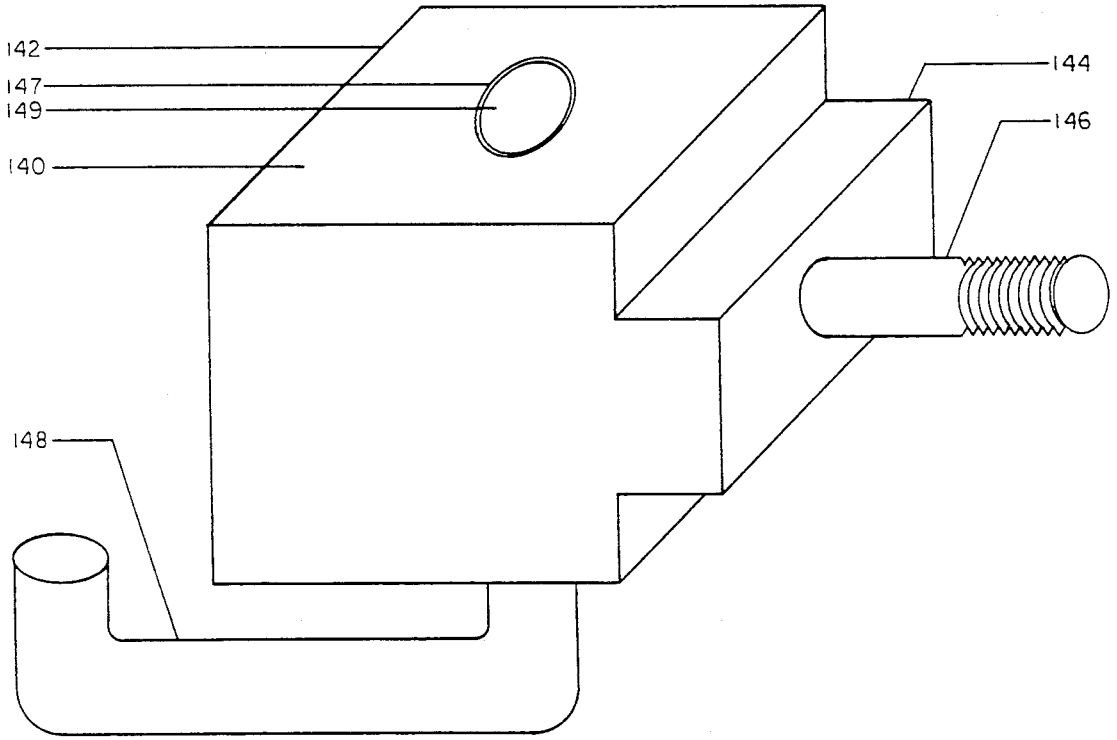
FIG. 9 is a load attachment arrangement for use with the carrying frame of FIG. 7.

A load-attachment assembly 140 for attaching a load to front support assembly 101 is shown in perspective in FIG. 9. It comprises a housing 142 provided with an extension member 144 for engaging groove 110 of adjustment member 105. A threaded stud 146 permanently bonded to housing 142 is provided for engagement with slot 115 in adjustment member 105 and extending through slot 113 in adjustment member 103. Slots 113 and 115 are coextensive in the areas of overlap between adjustment members 103 and 105 and the load-attachment assembly 140 may be adjustably mounted on front support assembly 101 and securely fastened by means of a threaded nut on stud 146 when the latter extends through slots 113 and 115. Load-attachment assembly 140 comprises a hook 148 for engaging a drum or other object to be carried. The hook 148 is provided with a vertical shaft 149 extending through housing 142 and secured by means of a snap ring 147. It will be readily apparent that more than one load-attachment assembly 140 may be attached to front support assembly 101 when such is desirable.

Figure 12:
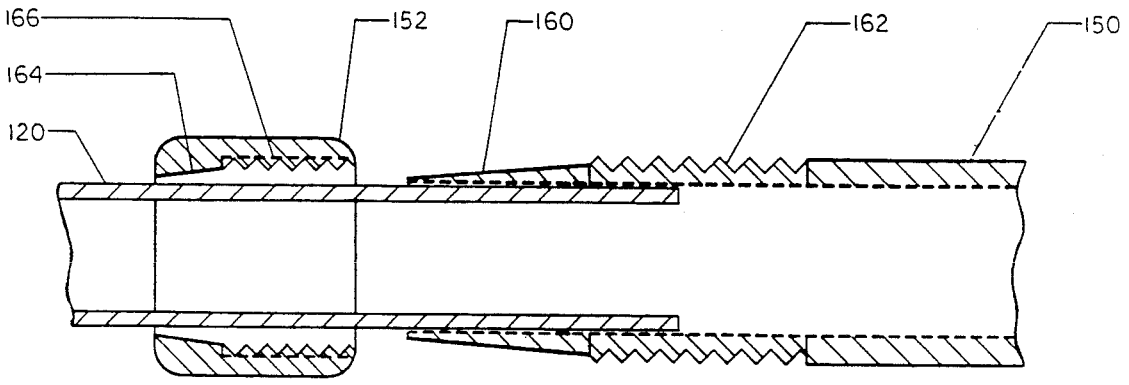
FIG. 12 is a cross-sectional view of a telescoping locking member taken along line 12—12 of FIG. 7.

Referring again to FIG. 7, front support arms 120 slidably engage a pair of curved side support members 150. The side support arms 150 are provided with locking collars 152 such that the support arms 120 may be readily adjusted for convenient front-to-back adjustment of the carrying device 100. FIG. 12 is a cross-sectional view of a locking collar arrangement taken along the line 12—12 of FIG. 7. Side support member 150 is provided with a smooth tapered end 160 and a threaded portion 162. Locking collar 152 is provided with a tapered end 164 for engaging the tapered end 160, thereby applying a compression force on front support arm 120. A threaded portion 166 of locking collar 152 engages threaded portion 162 for secure attachment. In addition to engaging front support arms 120, the side support members 150 also engage the reaction force member comprising back support members 154 and back pad assembly 155 hingedly attached to the back support members 154, in a manner generally as shown in FIG. 4. The slidable engagement between back support members 154 and side support members 150 allows for convenient height adjustment of the back pad assembly 155. Locking collars 152 provide a way of maintaining the back and side support members in a fixed position relative to each other.

Figure 8:
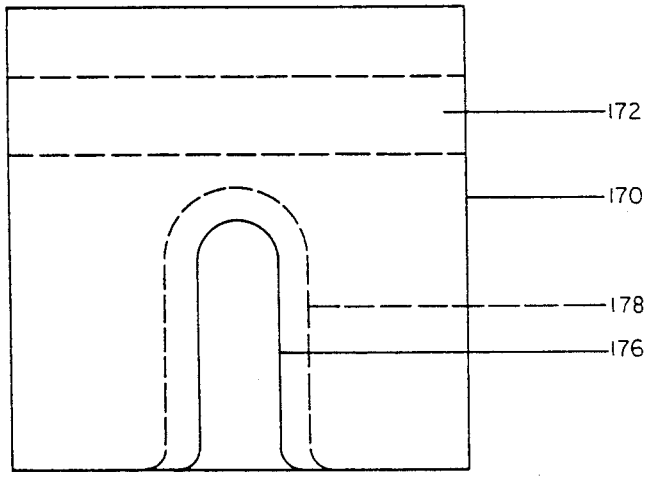
FIG. 8 is a side elevation of an attachment block of the carrying frame of FIG. 7.
Figure 11:
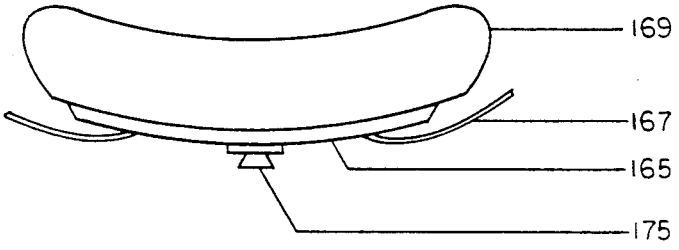
FIG. 11 is a top view of a left side hip plate for use with the carrying frame of FIG. 7.

Referring again to FIG. 7, side support members 150 are supported on hip plates 165 attached to a belt 167. Hip, pads 169 are attached to hip plates 165 by means of straps 168. Hip plates 165 attach to side support members 150 via a releasable rotational attachment to attachment block 170 by means of a dovetail attachment. Attachment block 170 is provided with an opening 172 and a slot 174 extending from the top of block 170 to opening 172 to provide an essentially non-slipping engagement with side support member 150. FIG. 8 is a side view of attachment block 170 showing an opening 176 for receiving a male dovetail member attached to hip plate 165. An enlarged internal area 178 for accommodating the male dovetail member is shown in phantom. FIG. 11 is a top view of left side hip plate 165 showing male dovetail member 175 for engagement with opening 176 of mounting block 170 shown in FIG. 8.

A person using the carrying device of this invention will generally first put on the belt 167 together with hip plates 165 and hip pads 169. If the load to be carried is to be carried in front of the person, the carrier frame consisting of front support assembly 101, front support arms 120, side support members 150 and back pad assembly 155, will be placed in the hip plates in such a manner that the front support assembly is in front of the person. However, it may also be desirable to carry a load behind a person's back. In that case, the orientation of the carrying device may be reversed with the back pad assembly 155 resting against the chest of the person and the front support assembly 101 extending behind the person. The front support assembly 101, in the case where the load is supported behind the back, may be replaced by a flexible support such as a strip or net or the like. Dovetail members on hip plates 165 can engage the support blocks 170 from either direction and hence the support mechanism is completely reversible. This reversibility is particularly advantageous when it is desirable to carry a heavy load behind a person, such as a heavy backpack. Shoulder straps may be used on the backpack to maintain balance, but the downward forces resulting from the weight of the backpack will be transferred to the region of the hips by means of the carrying device of this invention, thereby avoiding the bothersome downward pressures on the spine.

Figure 14:
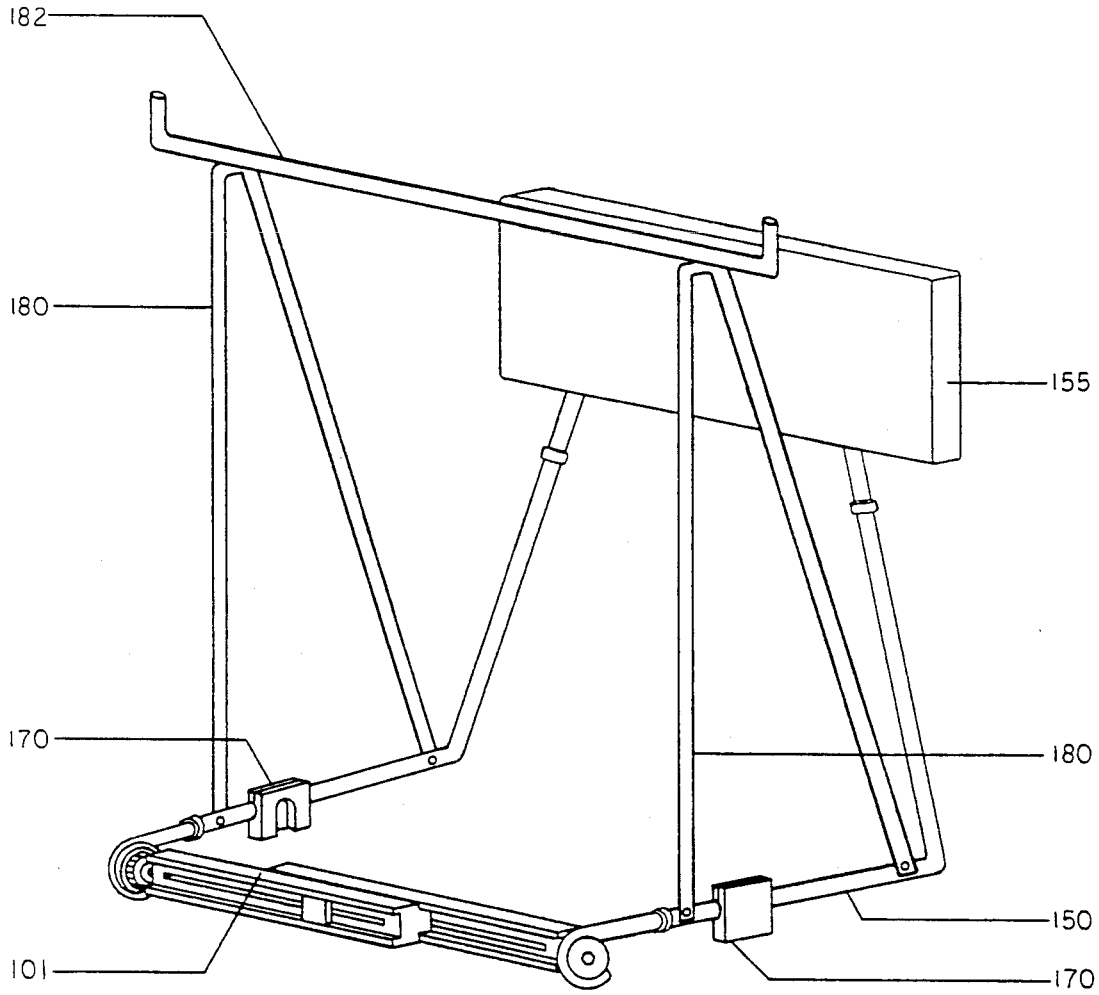
FIG. 14 is a perspective view of another alternate embodiment of a carrying frame in accordance with the invention.

FIG. 14 depicts yet another embodiment of the invention in which a pair of upwardly extending support brackets 180, in the form of an inverted V, are attached to side support members 150 by bolts or in another suitable manner. A cross member 182 is attached in a similar fashion to the top portion of the upwardly extending support members 180, to provide a frame for carrying a canoe or other heavy weight in an overhead position. The arrangement has the primary advantage of providing a convenient support frame while transmitting downward forces from items carried to the top region of the hips and away from the back and shoulders. The support members 180 as well as side support members 150, front arms 120 and back support members 154 may all be made of stainless steel tubing while the front support member 101 may be made of extruded aluminum to provide a strong but yet lightweight carrying frame. The frame allows heavy loads to be supported in a number of different positions without the necessity to support any of the load on the neck or shoulders of the person.

It will be understood that the embodiments described herein are only illustrative of the invention and that numerous variations thereof can be derived by those skilled in the art without departing from the spirit and scope of the invention.

What is claimed is:

1. A carrier frame to support an object in front of a person, comprising:

a pair of elongated spaced-apart substantially parallel side members for extending generally horizontally along the sides of a person in the region of the waist;

a front member engaging one end of each of said side members and extending in a generally horizontal direction, for supporting an object in front of the person; and a pair of elongated back members each having a first end portion connected to another opposing end of a respective side member and a second end portion, said back members generally extending upwardly and having a connection member connected between said second end portions thereof for engagement with the back thoracic region of a person;

said side members each comprising an attachment member for engagement with a support device supported on the person in the top regions of the hips, whereby downward forces resulting from the weight of a carried object are applied to the hips and reaction forces are applied to the back thoracic region of the person.

2. The carrier frame in accordance with claim 1, wherein said front member comprises a pair of substantially parallel overlapping front support members, each attached to one of said side members and each engaging the other of said support members and extending in a generally horizontal direction toward the other of said side members, whereby said side members may be adjustably positioned at a selected distance from each other along the front of a person.

3. The carrier frame in accordance with claim 1 wherein said back member extends in a plane positioned at an angle less than 90 degrees with respect to said side members.

4. The carrier frame in accordance with claim 1 further comprising an angle adaptor assembly attached to said front member for selectively positioning a carried item at different angular positions, said angle adaptor comprising a top plate extending generally horizontally and a pair of side plates extending in the downward direction;

said side plates each comprising a front edge, a section of which extends at an angular direction of less than 90 degrees with respect to said top plate;

a movable support member extending in a direction generally parallel to said front member and positioned against said front edges of said side plates;

an adjustment shaft extending through an opening in said top plate in a generally downward direction for engagement with said support member for positioning said support member along said front edges; and means for engaging an object to be carried, said means being hingedly attached at one end thereof to one or more of said top and side plates and having at least one surface contacting said support member, whereby operation of said adjustment shaft causes movement of said support member along said front edges and the angular position of said means for engaging an object to be carried varies with movement of said support member along said front edges.

5. The carrier frame in accordance with claim 1, wherein said front member comprises an angular member having a top plate and having at least one attachment hole and a front plate having at least one attachment hole, and wherein said side members each comprise means for detachably engaging said top and front plates of said front member comprising at least one engaging member extending generally in the vertical direction for engagement with said at least one attachment hole in said top plate and at least one engagement member extending in a generally horizontal direction for engagement with said at least one attachment hole in said front plate.

6. The carrier frame in accordance with claim 5, wherein said side members each comprise a pair of slidably engaged overlapping support members extending in the direction of said front member to allow for positional adjustment of said front member with respect to said attachment members of said side members.

7. The carrier frame in accordance with claim 6, wherein said overlapping support members comprise tubular members.

8. The carrier frame in accordance with claim 1, further comprising a support device for engagement with said attachment member, said support device comprising a belt and a pair of hip plates, attached to said belt, said hip plates each having a shape in general conformity with the outline of the hip of a person.

9. The carrier frame in accordance with claim 8 wherein each of said hip plates is provided with spaced-apart parallel slots and wherein said support device further comprises hip pads provided with attachment means extending through said slots for loosely attaching one of said pads to each of said hip plates to provide padding between said plates and the hips of a person.

10. The carrier frame in accordance with claim 8, and further comprising elongated dovetail detents rotationally engaging cylindrically-shaped male dovetail members for providing pivotal engagement between said support device and said attachment member.

11. A carrier frame for supporting an object to be carried by a person, comprising:

a pair of elongated spaced-apart substantially parallel side members for extending generally horizontally along the sides of a person in the region of the waist;

a cross member engaging one end of each of said side members and extending in a generally horizontal direction for supporting an object to be carried; and a reaction force member having a pair of elongated support members each including a first end portion connected to another opposing end of a respective side member and extending generally upwardly therefrom, and having a connecting member connected between upper end portions of said support members for engagement with the back of a person;

said side members each comprising an attachment member for engagement with a support device supported on the person in the top regions of the hips, whereby downward forces resulting from the weight of a carried object are applied to the hips and reaction forces are applied to an upper portion of the person.

12. The carrier frame in accordance with claim 11, wherein said connecting member comprises a support plate for providing a contact area with the torso of a person.

13. The frame in accordance with claim 12, wherein said support members are hingedly attached on said support plate thereby allowing lateral movement of said side members relative to each other along the waist area of a person.

14. The carrier frame in accordance with claim 13, wherein said support plate comprises arcuate slots and means extending through the said arcuate slots for fixedly positioning said support members at various angular positions relative to each other.

15. The carrier frame in accordance with claim 14, wherein said support members comprise slidably engaged overlapping members for allowing length adjustment of said reaction force member, and means for maintaining said overlapping members in a preselected position.

16. The carrier frame in accordance with claim 11, wherein said support member first end portions each comprise a lower section extending in a direction generally parallel to said side members and slidably engaging said side members for allowing position adjustment of said reaction force member in a direction generally parallel to said side members.

17. The carrier frame in accordance with claim 16, wherein said side members and said support members each comprise tubular members.

18. The carrier frame in accordance with claim 11 wherein said cross member comprises a pair of substantially parallel overlapping slidably engaging adjustment members, each attached to one of said side members and each extending in a generally horizontal direction toward the other of said side members, whereby said side members may be adjustably positioned at selected spaced-apart positions.

19. The carrier frame in accordance with claim 18 wherein one of said adjustment members comprises a horizontally extending groove and the other of said adjustment members comprises a corresponding extension for engagement with said groove and a fastener for maintaining said adjustment members in a fixed position relative to each other.

20. The carrier frame in accordance with claim 11 and further comprising an attachment member for rotatably attaching said cross member to said side members to allow for selective rotational orientation of said cross member, and means for selectively securing said cross member in a rotational orientation.

21. The carrier frame in accordance with claim 20 wherein said means for securing comprises a rotational member and a stationary member and a frictional surface positioned therebetween, and means for forcing said rotational member in the direction of said stationary member.

22. The carrier frame in accordance with claim 21 wherein said stationary member comprises a cylindrically-shaped housing having an outer wall and a generally radially extending detent in said wall, and wherein each of said side members comprises a curved section for engaging said outer wall and a generally radially extending protuberance for engaging said detent.

23. The carrier frame in accordance with claim 11 wherein each of said side members comprises a front arm for engaging said cross member, and a horizontal section slidably engaging said front arm.

24. The carrier frame in accordance with claim 11 wherein said cross member comprises a horizontally extending groove on one surface thereof and a horizontally extending slot, and further comprising a load-attachment member comprising an end piece for engaging said groove and attachment means for engaging said slot and for attaching said load-attaching device to said cross member, for sliding engagement of said end piece in said groove.

25. The carrier frame in accordance with claim 11 and further comprising a pair of upwardly extending support arms each having a lower end connected to a respective side member and a cross bar interconnecting upper ends of said upwardly extending support arms for supporting an overhead load.

* * * * *